US005557370A

United States Patent [19]

Kinoshita

[11] Patent Number: 5,557,370

[45] Date of Patent: Sep. 17, 1996

[54] CONTROL DEVICE FOR A FEED ROLLER

[75] Inventor: Naohisa Kinoshita, Nagoya, Japan

[73] Assignee: Brother Kogyo Kabushiki Kaisha, Nagoya, Japan

[21] Appl. No.: 330,555

[22] Filed: Oct. 28, 1994

[30] Foreign Application Priority Data

Oct. 29, 1993 [JP] Japan ..... 5-294541

[51] Int. Cl.[6] ..... G03G 15/20

[52] U.S. Cl. ..... 355/206; 355/290; 271/258.01

[58] Field of Search ..... 355/203, 205, 355/206, 285, 290, 316; 219/216, 469, 471; 432/60; 271/258.01

[56] References Cited

U.S. PATENT DOCUMENTS 3,650,618 3/1972 Volkers ..... 355/206
5,315,356 5/1994 Nagato et al. ..... 355/289
5,506,667 4/1996 Kinoshita ..... 355/290

FOREIGN PATENT DOCUMENTS 2-287581 11/1990 Japan ..... 355/205
4-125580 4/1992 Japan ..... 355/205

*Primary Examiner*—Joan H. Pendegrass
*Attorney, Agent, or Firm*—Oliff & Berridge

[57] ABSTRACT

A feed roller control device includes a feed roller having a first electrode layer with a plurality of connecting portions formed on a surface thereof, a resilient insulation layer having holes therethrough corresponding to the connecting portions and a second electrode layer. In a nip portion where a pressure roller abuts the feed roller, the insulation layer is resiliently compressed so that several ones of the plurality of electrode connecting portions of the first layer are in electrical contact with the second layer. A detecting unit detects the change in the amount of electrical current flowing between the electrode layers due to the increased number of contacts when a plate-shaped or sheet medium is in the nip portion.

16 Claims, 12 Drawing Sheets

CONTROL DEVICE FOR A FEED ROLLER

BACKGROUND OF THE INVENTION

1. Field of the Invention

The present invention relates to a control device for controlling a feed roller to feed a sheet of paper, or other sheet-like or plate-shaped medium, in a copy machine or a printer.

2. Description of the Related Art

Control devices are provided in printers, copy machines, and the like for controlling feed rollers such as those for feeding sheets of paper or other sheet-like or plate-shaped mediums. Such control devices usually work in association with one or more sensors disposed either upstream or downstream from the feed roller. The sensor is for detecting passage of sheets. The controller determines whether sheet feed is being correctly performed according to detection by the sensor. One type of sensor detects movement of sheets when mechanically displaced by the presence or absence of a sheet. Another type optically detects passage of a sheet when presence of the passing sheet blocks light from a light source.

However, the above-described control device requires added structure attaching the sensor. The additional structure complicates the device and makes provided a compact device difficult.

Feed rollers sometimes also function as thermal fixing devices for fixing toner onto sheets fed between two feed rollers. One of the feed rollers generates a high temperature. Toner on the transported sheet is melted by the high temperature and thereby fixed to the sheet. However, the high temperature can damage sensors that are disposed adjacent to the hot feed roller. Some sensors therefor can not be positioned too near the hot feed roller. This limits design options for feed rollers and associated sensors.

SUMMARY OF THE INVENTION

It is an objective of the present invention to provide a feed roller control device which does not employ a sensor to control a feed roller, and to provide a feed roller control device with a simple structure which can detect the feed condition of a medium to be fed, such as paper.

In order to attain the above object and other objects, the present invention provides a plate-shaped medium transporting device for transporting a plate-shaped medium, the device comprising: a feed roller rotatable about a feed roller axis, the feed roller including: a cylindrical first electrode layer provided substantially concentric with the feed roller axis, the first electrode layer having a plurality of electrode connecting portions formed to an electrode surface thereof at predetermined positions on the electrode surface; a cylindrical second electrode layer provided substantially concentric with the feed roller axis in confrontation with the electrode surface of the first electrode layer; and a cylindrical and resilient insulation layer provided interposed between the first electrode layer and the second electrode layer, the insulation layer having a plurality of through holes formed therethrough, each through hole being formed at a position in the insulation layer that corresponds to one of the predetermined positions of the electrode surface so that an electrode connecting portion is inserted in each through hole; a power source for supplying an electric power between the first and second electrode layers of the feed roller; drive means for driving the feed roller to rotate about the feed roller axis; a pressure roller rotatable about a pressure roller axis; a pressing member for resiliently pressing the pressure roller axis toward the feed roller axis so as to form a nip portion between the pressure roller and the feed roller where the pressure roller abuts the feed roller, the insulation layer of the feed roller becoming resiliently compressed at the nip portion so that several ones of the plurality of electrode connecting portions of the first electrode layer are brought into electrical connection with the second electrode layer at the nip portion, the number of the electrode connecting portions thus brought into electric connection increasing when a plate-shaped medium is sandwiched at the nip portion between the feed roller and the pressure roller; and detecting means for detecting change in an electrical amount obtained for the first and second electrode layers of the feed roller, to thereby determine feed condition of the plate-shaped medium.

The pressing member may include a resilient member for being resiliently deformed to urge the pressure roller against the heat roller to form the nip portion, with a biasing force of an amount corresponding to the feed condition of the plate-shaped medium at the nip portion.

According to another aspect, the present invention provides a feed roller control device for controlling a feed roller to transport a plate-shaped medium, the device comprising: a feed roller rotatable about a feed roller axis, the feed roller including: a cylindrical first electrode layer provided substantially concentric with the feed roller axis, the first electrode layer having a plurality of electrode connecting portions formed to an electrode surface thereof at predetermined positions on the electrode surface; a cylindrical second electrode layer provided substantially concentric with the feed roller axis in confrontation with the electrode surface of the first electrode layer; and a cylindrical and resilient insulation layer provided interposed between the first electrode layer and the second electrode layer, the insulation layer having a plurality of through holes formed therethrough, each through hole being formed at a position in the insulation layer that corresponds to one of the predetermined positions of the electrode surface so that an electrode connecting portion is inserted in each through hole; a power source for supplying an electric voltage between the first and second electrode layers of the feed roller; a pressure roller rotatable about a pressure roller axis; a drive source for driving the feed roller and the pressure roller to rotate about their roller axes; a pressing member for being resiliently deformed to urge the pressure roller axis toward the feed roller axis with a biasing force to form a nip portion between the pressure roller and the feed roller where the pressure roller abuts the feed roller, the biasing force having an amount corresponding to feed condition of the plate-shaped medium at the nip portion, the insulation layer of the feed roller being resiliently compressed at the nip portion in correspondence with the amount of the biasing force so that several ones of the plurality of electrode connecting portions of the first electrode layer are brought into electrical connection with the second electrode layer at the nip portion, the number of the electrode connecting portions thus brought into electric connection corresponding to the amount of the biasing force so as to increase when a plate-shaped medium is sandwiched at the nip portion between the feed roller and the pressure roller; a detecting unit for detecting change in an amount of electrical current flowing between the first and second electrode layers of the feed roller, to thereby determine the feed condition of the plate-shaped medium; and a controller for controlling operation of at least one of the drive source and the power source, based on the results detected by the detecting unit.

BRIEF DESCRIPTION OF THE DRAWINGS

The above and other objects, features and advantages of the invention will become more apparent from reading the following description of the preferred embodiment taken in connection with the accompanying drawings in which:

FIG. 4 (A) through 4 (C) are perspective views showing a electrode layer and a resilient layer of the heat roller shown in FIG. 2A, in which

FIG. 6 (B) is a cross-sectional view taken along line 6B—6B in FIG. 5 showing the structure of the electrode layer, the resilient layer, and the resistance layer at the nip portion of the heat roller;

DETAILED DESCRIPTION OF THE PREFERRED EMBODIMENTS

Figure 1:
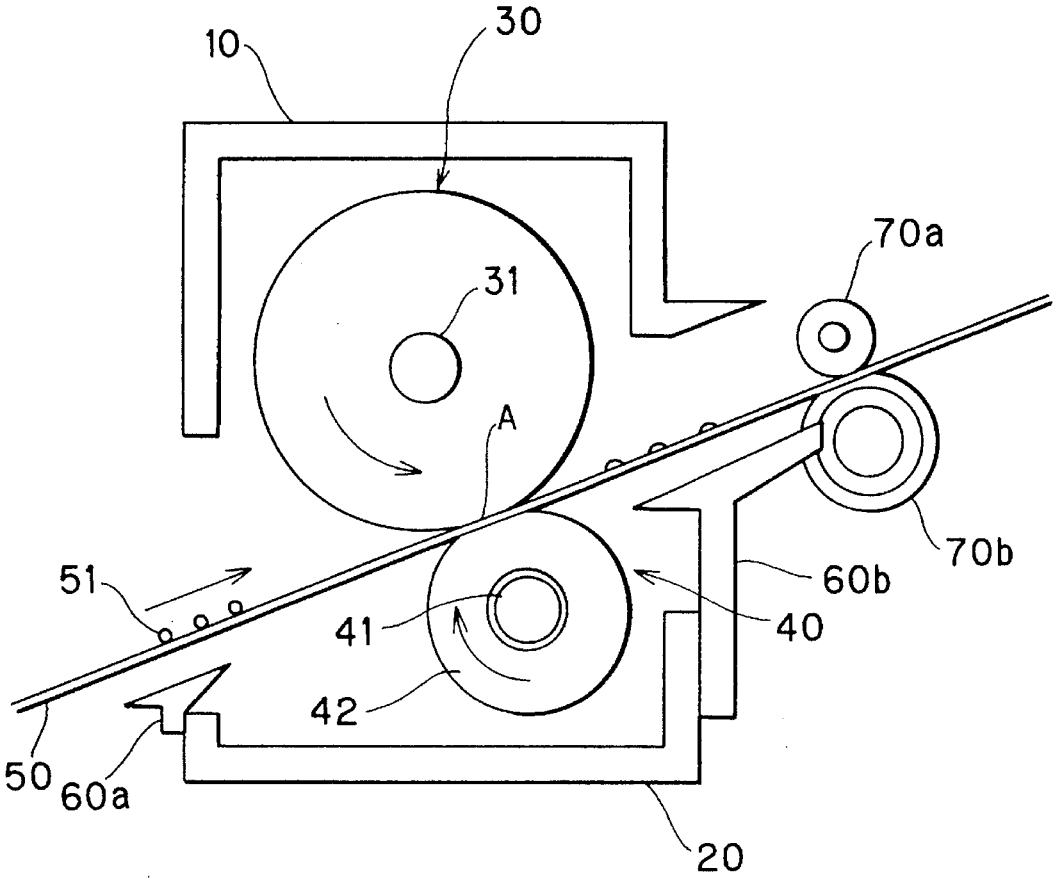
FIG. 1 is a cross-sectional schematic view showing a thermal fixing device according to a first preferred embodiment of the present invention.

A feed roller control device according to preferred embodiments of the present invention will be described while referring to the accompanying drawings wherein like parts and components are designated by the same reference numerals to avoid duplicating description.

FIG. 1 shows a first preferred embodiment of a thermal fixing device according to the present invention. The thermal fixing device includes upper and lower covers 10 and 20, heat roller 30, and pressure roller 40. The upper and lower covers 10 and 20 are provided in opposition and so as to be openable. The heat roller 30 is provided in the interior of the upper cover 10, and the pressure roller 40 is provided in the interior of the lower cover 20.

Figure 2A:
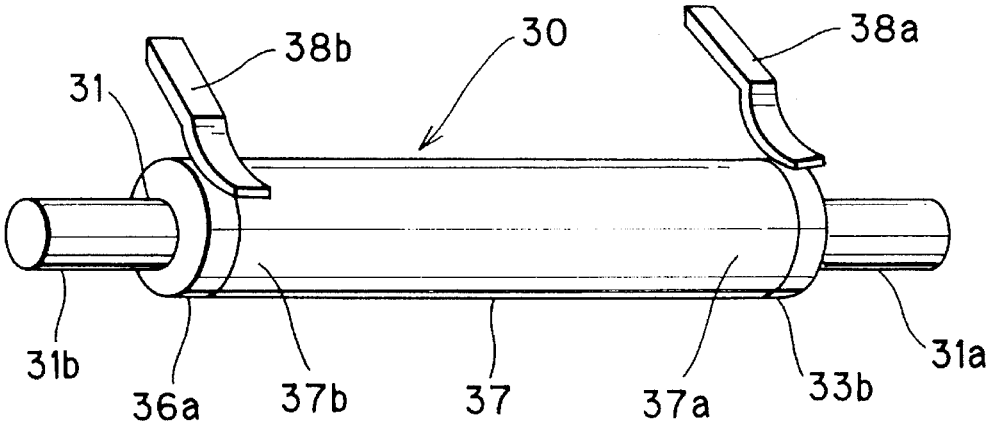
FIG. 2A is a perspective view showing a heat roller provided to the thermal fixing device shown in FIG. 1.
Figure 2B:
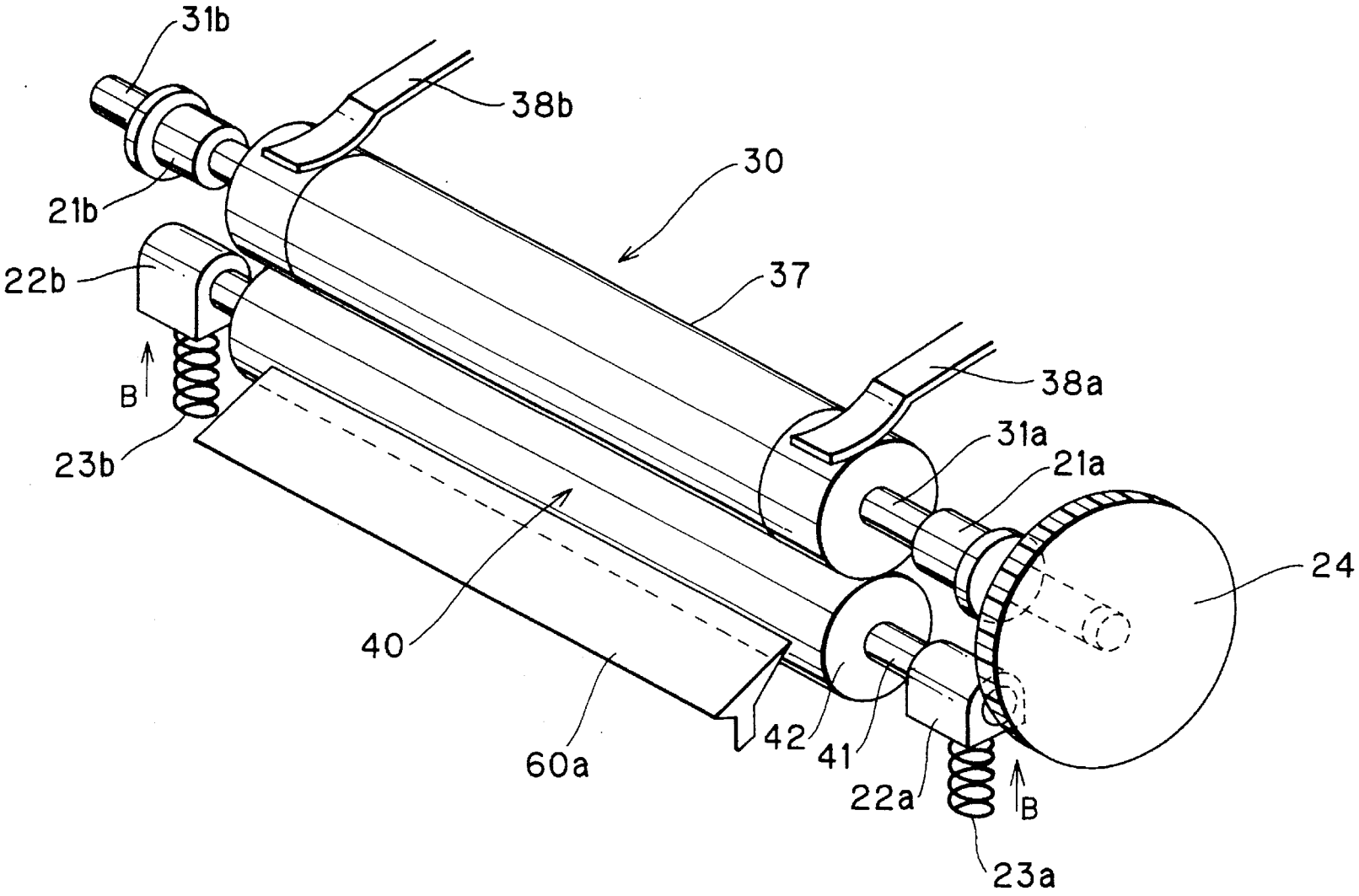
FIG. 2B is a perspective view showing the state how the heat roller and a pressure roller are mounted in the interior of the thermal fixing device of FIG. 1 where the walls of covers constituting the thermal fixing device are omitted for clarity and simplicity.

As shown in FIG. 2A, the heat roller 30 includes a central axis 31 having two opposite end portions 31a and 3lb. As shown in FIG. 2B, both end portions 31*a* and 31*b* of the central axis 31 are rotatably supported in two bearings 21*a* and 21*b*, which are fixedly provided to opposing inner side walls of the upper cover 10 (not shown.) Thus, the heat roller 30 is disposed within the cover 10 so as to be concentrically rotatable around the central axis 31. The heat roller 30 serves to generate heat in a manner to be described later.

The pressure roller 40 includes a central axis 41 and a resilient roller portion 42. The resilient roller portion 42 is formed to the perimeter of the central axis 41 from a heat resistant resilient material such as silicon rubber. Both ends of the central axis 41 are rotatably supported on two bearings 22*a* and 22*b*. The two bearings 22*a* and 22*b* are mounted on two coil spring members 23*a* and 23*b*, which are mounted on an inner bottom wall (floor) of the lower cover 20 (not shown.) Each coil spring has one end fixedly attached to the inner bottom wall of the cover 20 and the other end fixedly attached to the corresponding bearing. Thus, the pressure roller 40 is mounted, via the bearings 22*a* and 22*b* and the springs 23*a* and 23*b*, on the bottom wall of the cover 20 so that the pressure roller 40 is rotatable above the floor (inner bottom wall) of the cover 20 about the central axis 41.

The pressure roller 40 is supported on the coil springs 23*a* and 23*b* so that the outer surface of the resilient roller 42 abuts the heat roller 30. The coil spring members 23*a* and 23*b* are for being resiliently deformed in a direction, indicated by an arrow B in FIG. 2B, toward the heat roller 30 disposed in the upper cover 10. Thus, the coil spring members 23*a* and 23*b* are for being resiliently deformed to urge, via the bearings 22*a* and 22*b*, the outer surface of the resilient roller portion 42 against the outer surface of the heat roller 30. Pressure applied by the spring members 23*a* and 23*b* forms a nip portion A (refer to FIG. 5) at the region where the pressure roller 40 abuts the heat roller 30. The nip portion A will be described in more detail later. It is noted that guide members (not shown) are provided in the interior of the lower cover 20 for guiding the bearings 22*a* and 22*b* in the direction B toward the heat roller 30.

A driving gear 24 engaged with a drive motor (not shown) is provided to the central axis 31 of the heat roller 30 for rotating the heat roller 30. The pressure roller 40 in abutment contact with the heat roller 30 rotates in association with the heat roller 30. The heat roller 30 and the pressure roller 40 rotate in the directions indicated by arrows in FIG. 1. The rotation of the heat roller 30 and the pressure roller 40 transports a sheet 50 with toner 51 thereon between the heat roller 30 and the pressure roller 40. Sheet guides 60*a* and 60*b* are provided for guiding sheets 50 to predetermined positions. Sheet discharge rollers 70*a* and 70*b* are provided for discharging sheets 50 from the device. The heat from the heat roller 30 melts the toner 51 on the sheet 50, thereby fixing the toner 51 to the sheet 50. The thermal fixing device according to the first preferred embodiment therefore functions generally for transporting sheets and also for heating and melting toner 51 to fix the toner 51 to sheets 50.

Figure 3:
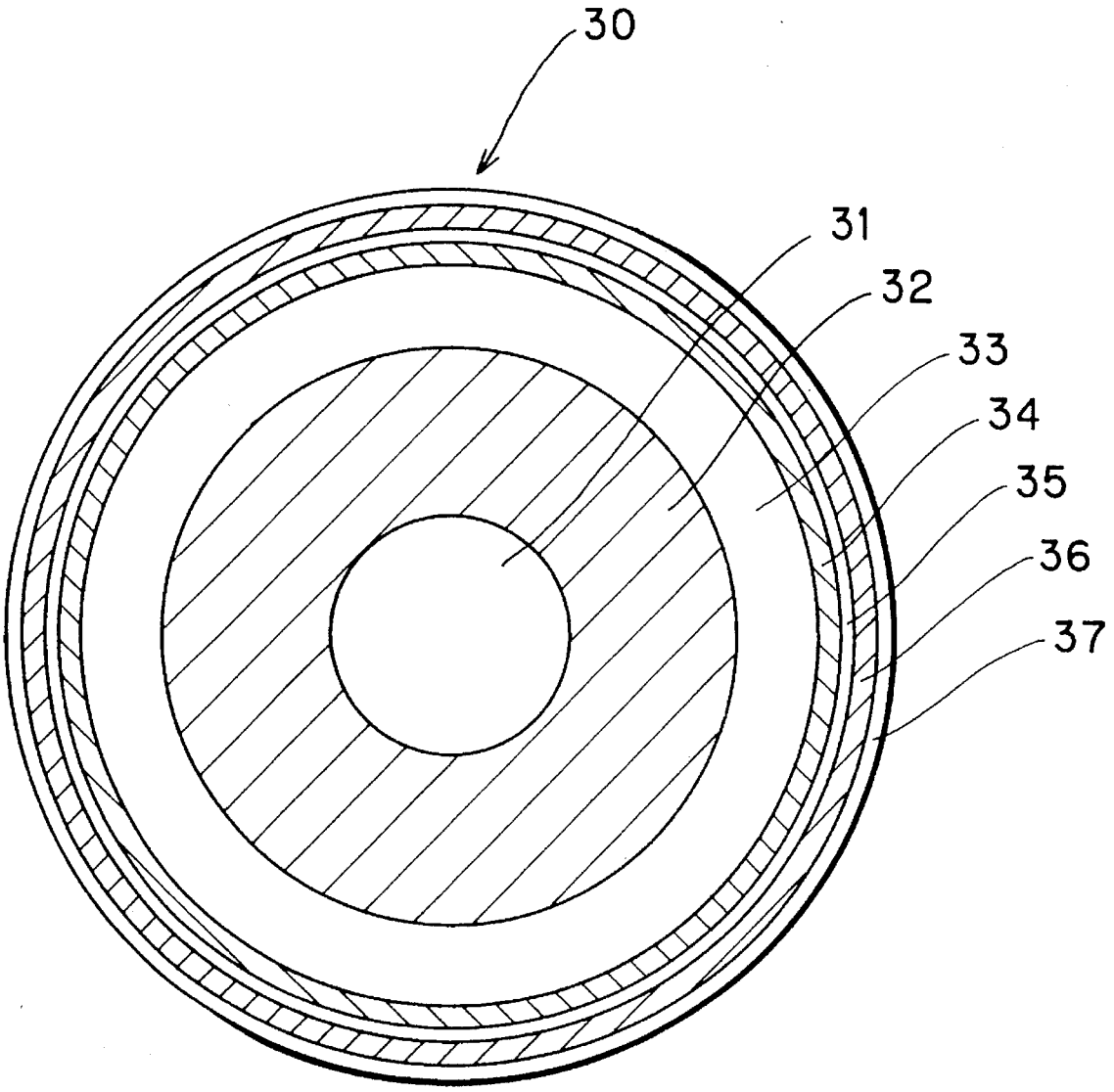
FIG. 3 is a cross-sectional view of the heat roller shown in FIG. 2A.

Next, an explanation of the structure of the heat roller 30 will be provided while referring to FIGS. 1 through 6. As can be seen in FIG. 3, the heat roller 30 is formed from a plurality of concentric layers including, in order outward from the central axis 31, a base portion 32, an electrode layer 33, a resilient layer 34, a resistor layer 35, a common electrode 36, and an anti-melt layer 37. Confronting surfaces of adjacent layers are adhered together by an adhesive agent or other adhesive force. More specifically, the confronting surfaces of adjacent layers may be adhered together by adhesive force which is obtained when they are produced through vapor deposition process one on the other. This adhesive force results from Van der Vaals force, intermolecular force, anchoring force, force generated by film-shaped solid solution obtained through the vapor deposition process, and the like.

The cylindrical base portion 32 is formed concentrically to the perimeter of the central axis 31. The central axis 31 is made from a metal material and the base portion 32 is formed from an insulation material that is slightly resilient such as rubber or resin.

Figure 4A:
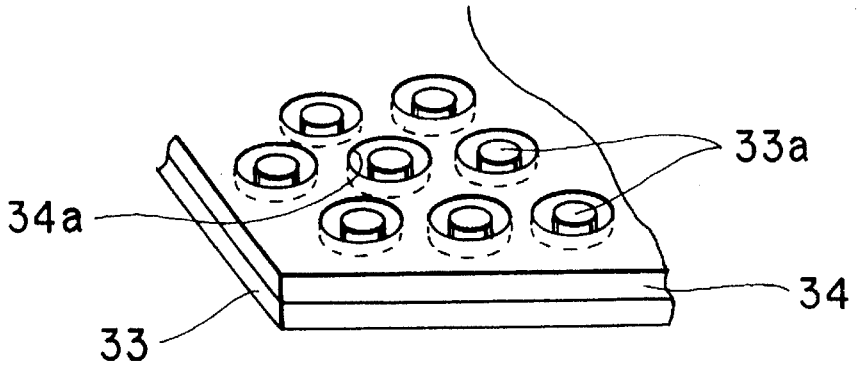
FIG. 4(A) shows the state where the resilient layer is attached to the electrode layer.
Figure 4B:
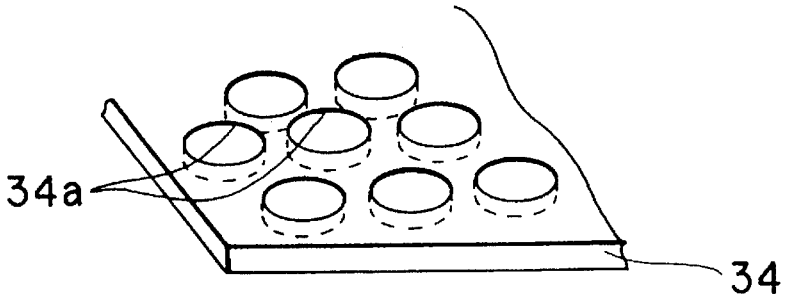
FIG. 4(B) shows the resilient layer, and FIG. 4 (C) shows the electrode layer.
Figure 4C:
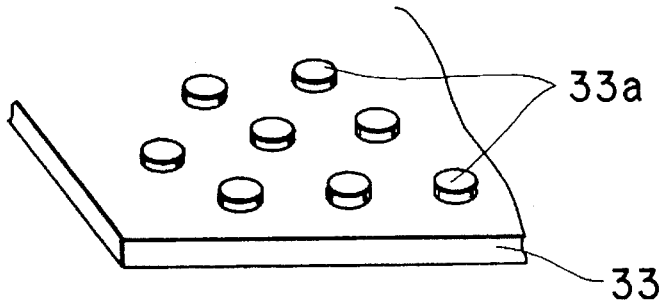

The cylindrical electrode layer 33 is formed concentrically to the perimeter of the base portion 32. The cylindrical electrode layer 33 is made mainly from a conductive metal material such as aluminum. As shown in FIG. 4 (C), a plurality of cylindrical pillar-shaped electrode portions 33*a* are provided to the perimeter of the electrode layer 33 in a predetermined pattern. The electrode layer 33 and each electrode portion 33*a* are provided in electrical connection. The electrode portions 33*a* need not be formed in cylindrical shapes, but can also be formed into cubical, hemispherical, or other protruding shapes. In the first preferred embodiment, the electrode portions 33*a* are made from a heat resistant and friction resistant material such as tungsten because the tip of each electrode portion 33*a* is subjected to high temperatures and high pressure. The electrode portions 33*a* can be formed from the same material as the electrode layer 33 or formed from different material but formed integrally with the electrode layer 33.

The resilient layer 34 is formed into a cylindrical shape from a resilient insulation material to the perimeter of the electrode layer 33. As shown in FIG. 4 (B), cylindrical through holes 34*a* are formed in the resilient layer 34 at positions corresponding to the positions of the electrode portions 33*a*. As shown in FIG. 4(A), the resilient layer 34 is provided over the cylindrical electrode layer 33 with each electrode portion 33*a* being concentrically inserted into a corresponding through hole 34*a*. The thickness of the resilient layer 34 is larger than the height of the electrode portions 33*a*. In other words, the through holes 34*a* have a depth greater than the height of the electrode portions 33*a*. Therefore, when the resilient layer 34 is adhered to the cylindrical electrode layer 33, a gap is formed between the outer end of the electrode portions 33*a* and the outer surface of the resilient layer 34, that is, the opening of the through holes 34*a* that faces outward. The through holes 34*a* are formed with an outer diameter that is greater than the outer diameter of the electrode portions 33*a*.

As shown in FIG. 3, the resistor layer 35 is formed in a cylindrical shape with a thickness of about 20 micrometers and concentrically provided to the perimeter of the resilient layer 34. The resistor layer 35 is made from a carbon dispersed in a polycarbonate net film so as to have a predetermined volume resistivity.

The common electrode layer 36 is formed from a material such as aluminum into a cylindrical layer that is from 1,000 angstroms to 0.2 millimeters thick. The common electrode layer 36 is concentrically formed to the perimeter of the resistor layer 35 through vacuum vapor deposition process.

The anti-melt layer 37 is formed into a cylindrical shape from a material such as tetrafluoroethylene. The anti-melt layer 37 is formed concentrically to the perimeter of the common electrode layer 36 and forms the outermost layer of the heat roller 30. The anti-melt layer 37 prevents melted toner 51 from sticking to the perimeter of the heat roller 30 during thermal fixation processes.

At the left (as seen in FIG. 2A) end portion 37*b* of the heat roller 30, the anti-melt layer 37 is formed shorter than the other layers so as to expose a left-side portion 36*a* of the common electrode layer 36. At the right (as seen in FIG. 2A) end portion 37*a* of the heat roller 30, the resilient layer 34, the resistor layer 35, the common electrode layer 36, and the anti-melt layer 37 are formed shorter than the other layers so as to expose a right-side portion 33*b* of the electrode layer 33. A negative electrode 38*b* is disposed above and in contact with the left portion 36*a* of the common electrode layer 36. A positive electrode 38*a* is disposed above and in contact with the right portion 33*b* of the electrode layer 33. Both electrodes 38*a* and 38*b* are fixed at an appropriate portion of the base.

Figure 5:
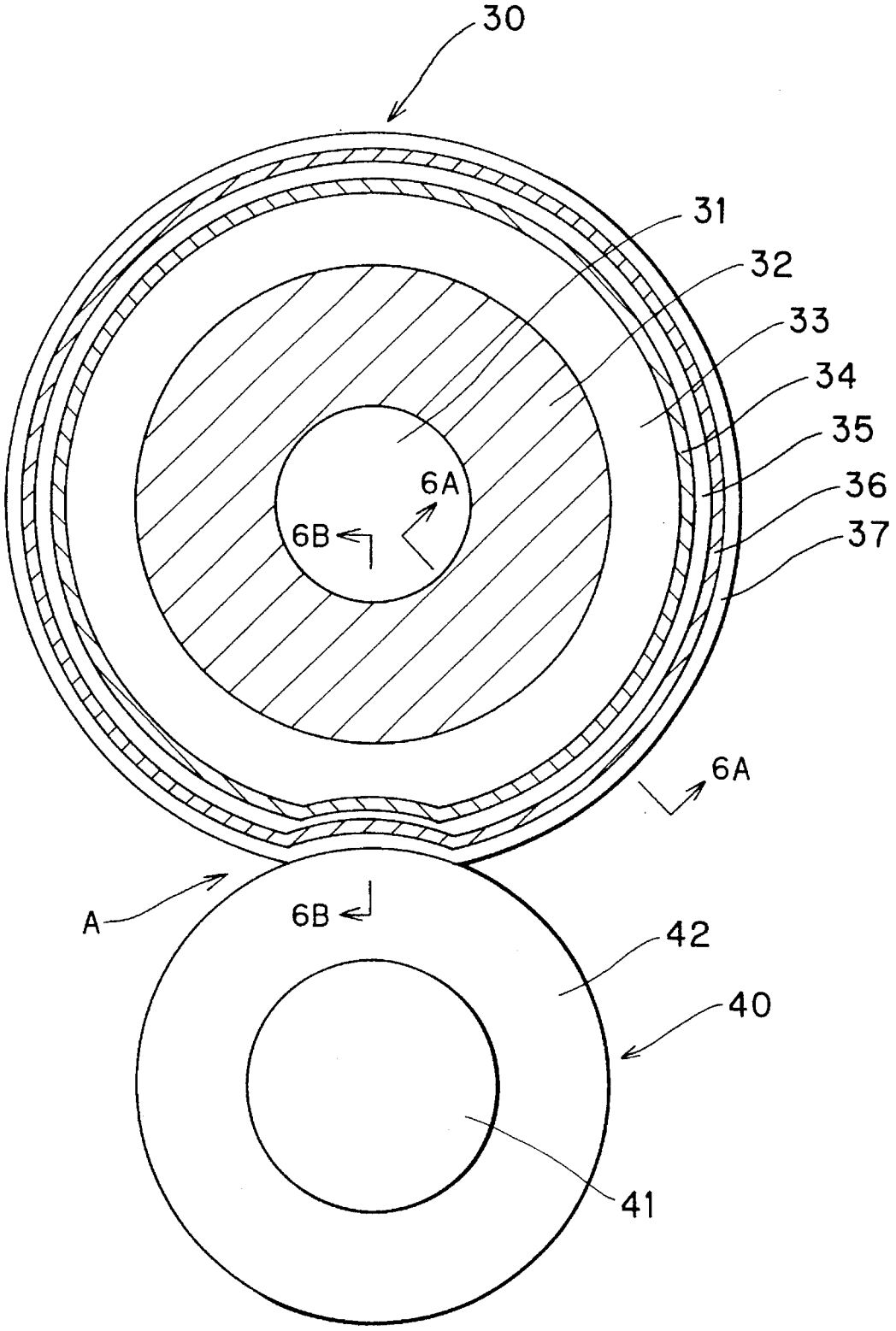
FIG. 5 is a cross-sectional view showing the heat roller in pressing contact with a pressure roller so that a nip portion is formed in the heat roller.

As shown in FIG. 5, the pressure roller 40 and the heat roller 30 are disposed in abutment. The pressure roller 40 urged by the coil springs 23*a* and 23*b* applies pressure to the heat roller 30. The resilient layer 34 receives the pressure and is resiliently deformed to form a nip portion A where the pressure roller 40 and the heat roller 30 abut. Similarly, the resilient roller portion 42 of the pressure roller 40 receives pressure from the heat roller 30 and deforms at the nip portion A. The nip portion A insures that sufficient area and pressure required for thermal fixation is provided between the pressure roller 40 and the heat roller 30.

Figure 6A:
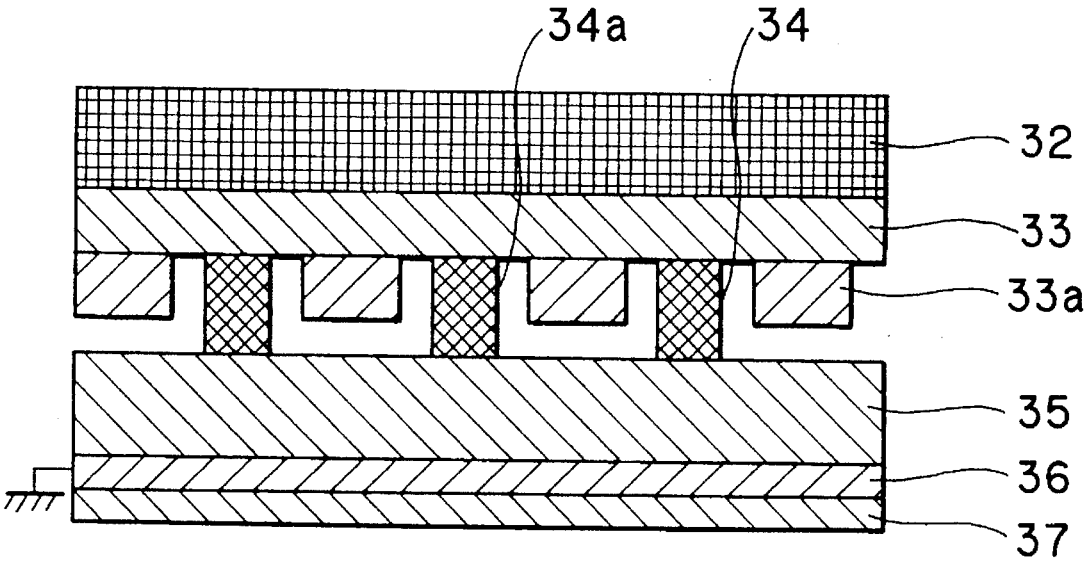
FIG. 6 (A) is a cross-sectional view taken along line 6A—6A in FIG. 5 showing the structure of the electrode layer, the resilient layer, and a resistance layer at portions of the heat roller other than at the nip portion.
Figure 6B:
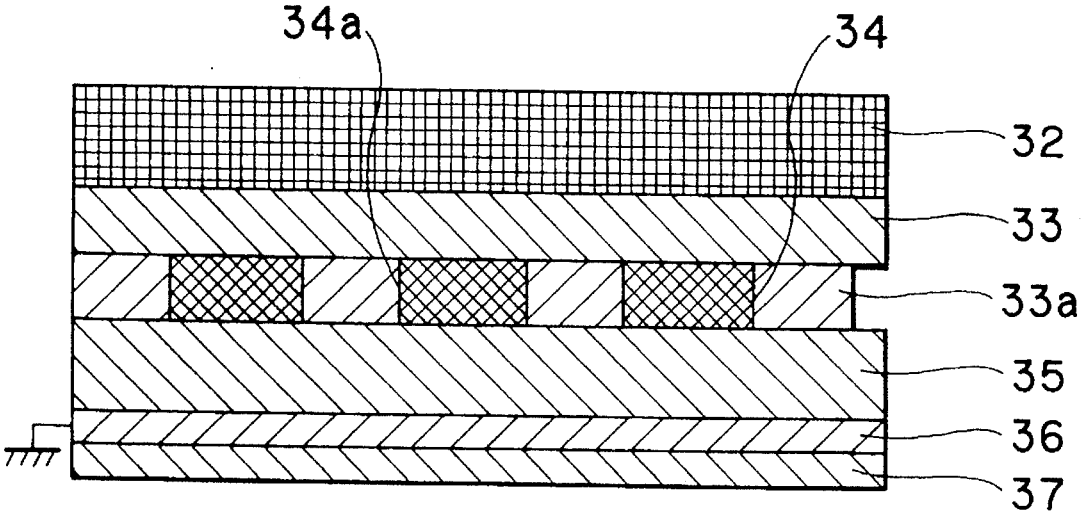

Because, the resilient layer 34 does not deform at portions thereof where the heat roller 30 and the pressure roller 40 are not in abutment, i.e., at positions other than the nip portion A, the electrode portions 33*a* of the electrode layer 33 and the resistor layer 35 remain in a condition of non-contact as shown in FIG. 6(A). No current flows between the electrode layer 33 and the resistor layer 35 at these portions. However, compression of the resilient layer 34 at the nip portion A brings each electrode 33*a* at the nip portion A into contact with its respective resistor layer 35 as shown in FIG. 6(B). In this condition, electrodes 33*a* at the nip portion A are electrically connected to the resistor layer 35.

Figure 7:
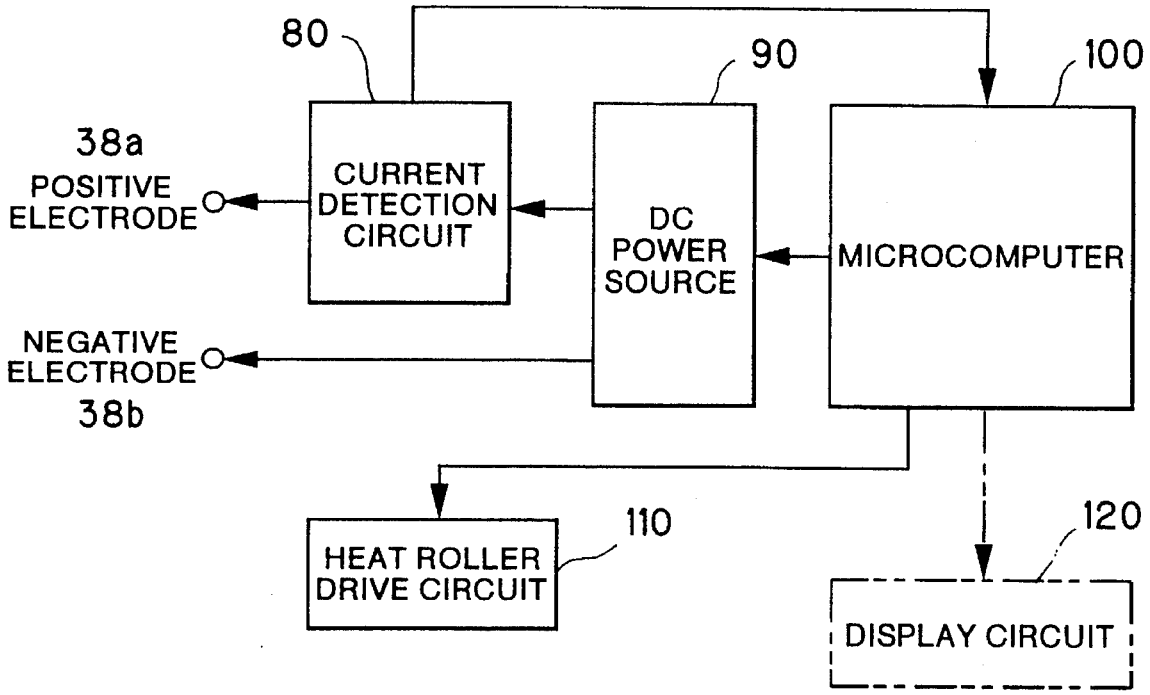
FIG. 7 is a circuit diagram showing circuitry for driving the heat roller and applying a direct voltage to the heat roller.

Next, an explanation of the structure of electronic circuitry in the device according to the present invention will be provided while referring to solid lines in FIG. 7. The electronic circuitry of the device in the first preferred embodiment includes a current detection circuit 80, a DC power source 90, a microcomputer 100, and a heat roller drive circuit 110. One output of the microcomputer 100 is connected to the DC power source 90 and another output is connected to the heat roller drive circuit 110. The DC power source 90 is connected by its positive terminal to the positive electrode 38*a* and by its negative terminal to the negative electrode 38*b*.

The current detection circuit 80 is connected between the DC power source 90 and the positive electrode 38*a*. An output of the current detector circuit 80 is connected to an input of the microcomputer 100. The current detection circuit 80 is for detecting DC current flowing from the DC power source 90 through the positive electrode 38*a* to the exposed end portion 33*b* of the electrode layer 33 of the heat roller 30 and then outputting the detected value to the microcomputer 100.

Figure 8:
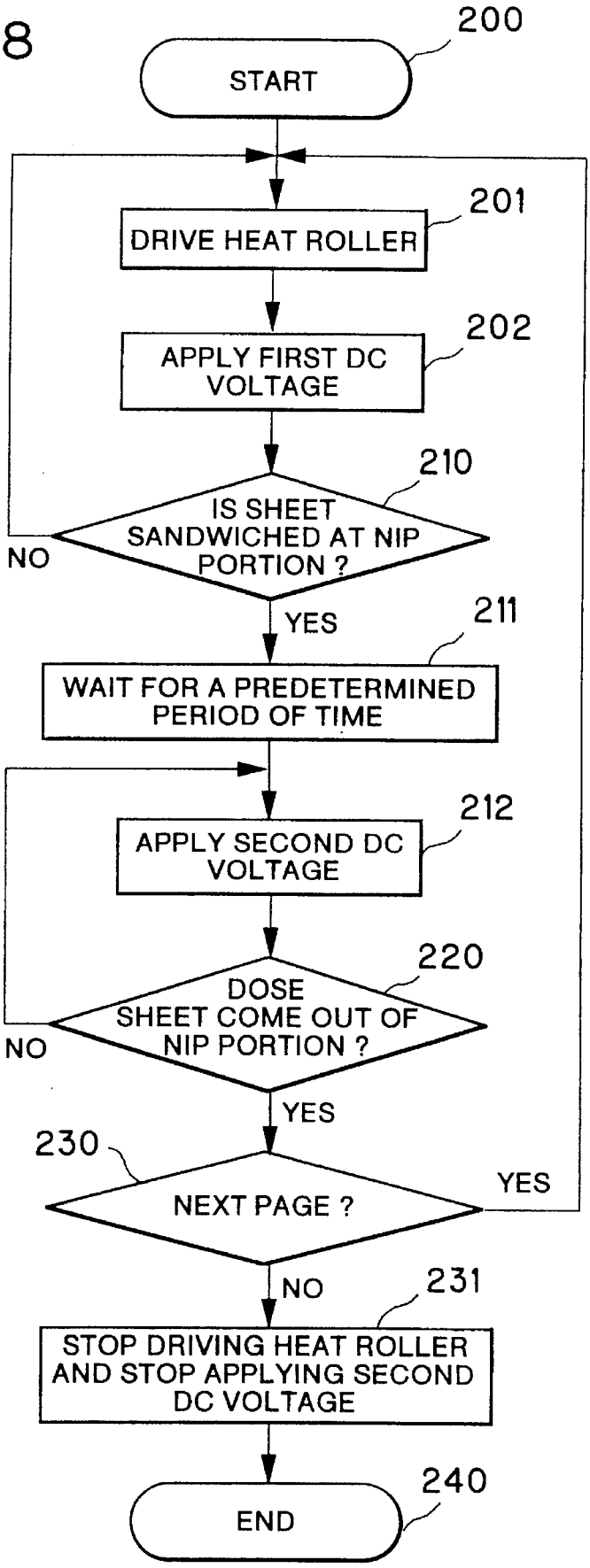
FIG. 8 is a flowchart representing a computer program stored in the microcomputer shown in FIG. 7.

The microcomputer 100 includes a CPU, a RAM, a ROM (not shown), and the like. Computer programs, including a program represented by the flowchart in FIG. 8 are prestored in the ROM. The CPU of the microcomputer 100 executes computer programs according to output from the current detection circuit 80 and according to the flowchart shown in FIG. 8. During execution of the computer programs, the microcomputer 100 performs calculation processes required to control drive of the DC power source 90 and the heat roller drive circuit 110.

During control of the DC power source 90, the microcomputer 100 determines whether a first or second DC voltage is to be applied between the exposed end portion 36*a* of the common electrode layer 36 and the exposed end portion 33*b* of the electrode layer 33 of the heat roller 30 via the current detection circuit 80 and both electrodes 38*a* and 38*b*. The first DC voltage is of a small value for determining whether a sheet 50 is sandwiched in the nip portion A. The second DC voltage is of a value large enough to cause the heat roller 30 to heat sufficiently for thermally fixing toner 51 onto a sheet 50.

The following text explains thermal fixing operations as performed by the thermal fixing device according to the first preferred embodiment described above. When the thermal fixing device is turned on, the microcomputer 100 follows the flowchart shown in FIG. 8. Execution of the computer program starts with initialization processes in step 200. At this first stage, a sheet 50 with toner 51 attached thereto is not supported in the nip portion A formed between the heat roller 30 and the pressure roller 40, and also a DC voltage is not being applied to the heat roller 30. As shown in FIG. 6(B), because the resilient layer 34 is resiliently deformed at the nip portion A due to the pressure applied from the coil springs 23*a* and 23*b*, the electrode portions 33*a* of the electrode layer 33, positioned at the nip portion A, protrude through the through holes 34*a* of the deformed resilient layer 34 and come into contact with corresponding portions of the resistor layer 35.

After execution of the computer program starts, in step 201 the microcomputer 100 outputs to the heat roller drive circuit 110 a drive command signal required for driving the heat roller 30. As a result, the heat roller drive circuit 110 drives the drive motor (not shown), which in turn rotates the heat roller 30 via the drive gear 24. The pressure roller 40 rotates in association with the heat roller 30. Next, in step 202, the microcomputer 100 outputs to the DC power source 90 a first energization command signal required for application of the first DC voltage. The DC power source 90 applies the first DC voltage to the electrodes 38*a* and 38*b*, which then applies the first DC voltage to the exposed right-side portion 33*b* of the electrode layer 33 and to the exposed left-side portion 36*a* of the common electrode layer 36, respectively. At this time, by application of the first DC voltage, a first DC current flows through the closed circuit formed by the negative electrode 38*b*, the common electrode layer 36, the resistor layer 35, the electrode portions 33*a* at the nip portion A, the electrode layer 33, the positive electrode 38*a*, the current detection circuit 80, and the DC power source 90. The region corresponding to the nip portion A becomes energized as a result. The first DC current as detected by the current detection circuit 80 has a small value, when no sheet is thus sandwiched at the nip portion A. This small value is determined dependently on the value of the first DC voltage and the resilient characteristics of the coil spring members 23*a* and 23*b* and the resilient layer 34. This small value will be referred to as an "initial value," hereinafter. Next, a sheet 50 is transported in the direction of the heat roller 30 until the tip (leading edge) of the sheet 50 becomes sandwiched at the nip portion A. The resiliency of the spring members 23*a* and 23*b* increases their biasing force for urging the pressure roller 40 to the heat roller 30, by an amount proportional to the thickness of the sheet 50. This increase in the biasing force is added to the pressure applied to the nip portion A. For this reason, the resilient layer 34 that is already resiliently deformed at the nip portion A is further resiliently compressed. Accordingly, the number of electrode portions 33*a* that contact the resistor layer 35 increases to greater than when no sheet 50 is sandwiched in the nip portion A. This translates into an area of contact between the electrode layer 33 and the resistor layer 35 that is greater than when no sheet is sandwiched in the nip portion A. Thus, the first DC current detected for the first DC voltage when a sheet 50 is sandwiched in the nip portion A has a value greater than the initial value obtained when no sheet is sandwiched in the nip portion A. This value falls in a predetermined first range, which is determined dependently on the characteristics of the sheet sandwiched in the nip portion A, the first DC voltage, and the resilient characteristics of the coil spring members 23*a* and 23*b* and the resilient layer 34.

Accordingly, when a leading edge of the sheet begins sandwiched at the nip portion A, the first DC current detected for the first DC voltage increases from the initial value to fall in the first predetermined range. Thus, in step 210, the microcomputer 100 judges whether a leading edge of a sheet 50 reaches the nip portion A, based on the current detected at the current detection circuit 80. The above-described increase in the first DC current signifies that a sheet 50 is at the nip portion A, so the computer program proceeds to step 211 accordingly. Thus, the determination of whether or not a paper is present at the nip portion A is not dependent on any independent sensor, but instead uses the structure of the heat roller 30 itself.

In step 211, the microcomputer 100 waits for a predetermined period of time needed for the sheet 50 to be transported from when a leading edge of the sheet begins sandwiched at the nip portion A until when a trailing edge of a margin portion (which does not have toner attached thereto and so does not need to be heated) of the sheet 50 reaches the nip portion A. After the waiting time passes the program proceeds to step 212.

In step 212, the microcomputer 100 outputs a second energization command signal to the DC power source 90. The second energization command signal causes the DC power source 90 to apply the second DC voltage to the heat roller 30 via the electrodes 38*a* and 38*b* as described above for application of the second DC voltage. As a result, a second DC current flows through the closed circuit formed by the negative electrode 38*b*, the common electrode layer 36, the resistor layer 35, the electrode portions 33*a* at the nip portion A, the electrode layer 33, the positive electrode 38*a*, the current detection circuit 80, and the DC power source 90. The second DC current flows to the region of the resistor layer 35 corresponding to the nip portion A, causing the region of the resistor layer 35 to heat by an amount that corresponds to its resistance value. The resultant thermal energy is transmitted from the resistor layer 35, through the region of the common electrode layer 36 and the anti-melt layer 37 corresponding to the nip portion A, to the sheet 50 being transported through the nip portion A by rotation of the heat roller 30 and the pressure roller 40. This second DC current has a value falling in a predetermined second range, which is determined dependently on the characteristics of the sheet 50 sandwiched at the nip portion A, the value of the second DC voltage, and the resilient characteristics of the coil spring members 23*a* and 23*b* and the resilient layer 34. The second DC current falling in the second range is capable of causing the resistor layer 35 to sufficiently heat to thermally fix toner 51 onto a sheet 50. Consequently, the toner 51 on the sheet 50 is melted by the thermal energy at the nip portion A and thermally attached to the sheet 50. As the sheet 50 is transported in the manner described above, the toner 51 provided over an entire surface of the sheet 50 is thermally attached to the sheet 50. These processes are accomplished smoothly and with high quality.

Afterward, the sheet 50 sandwiched in the nip portion A is further transported until the trailing edge of the sheet 50 is discharged from the nip portion A. At this point, the resiliency of the spring members 23*a* and 23*b* decreases their biasing force for urging the pressure roller 40 to the heat roller 30, by an amount proportional to the thickness of the sheet 50. This drop in the biasing force translates into a decrease in the amount of pressure that the pressure roller 40 applies to the nip portion A of the heat roller 30. For this reason, the amount of compression decreases at the resiliently-deformed portion of the resilient layer 34 at the region of the heat roller 30 corresponding to the nip portion A. The number of electrodes 33*a* of the electrode layer 33 contacting the resistor layer 35 decreases to a number that is less than when a sheet 50 is sandwiched in the nip portion A. This translates into a decrease in the area of contact between the electrode layer 33 and resistor layer 35 compared to when a sheet 50 is sandwiched in the nip portion A. Thus, when the sheet 50 is discharged from the nip portion A, the value of the second DC current decreases into a value smaller than that obtained when a sheet 50 is sandwiched in the nip portion A. This value is determined dependently on the value of the second DC voltage and the resilient characteristics of the coil springs 23*a* and 23*b* and the resilient layer 34.

In step 220, the microcomputer 100 determines, based on the reduction of the second DC current, that no sheet 50 is sandwiched in the nip portion A. Thus, this determination is not dependent on any independent sensor, but is based on effective use of the heat roller 30 itself. The reduction in pressure at the nip portion A that accompanies discharge of the sheet 50 results in a reduction in the second DC current. The reduction in the second DC current is detected and the computer program proceeds to step 230.

The step 230 judges whether a next sheet 50 is present to be thermally fixed by the thermally fixing device. The microcomputer 100 is supplied with information whether the next sheet is present, through a program other than the program of FIG. 8 of thermal fixing operation. The microcomputer 100 achieves the judgment of the step 230 based on the thus supplied information. When a next sheet is judged as present in step 230, the process returns to step 201, so that the step 201 and on are repeated. On the other hand, when the judgement in step 230 is "NO", in step 231 the microcomputer 100 outputs to the heat roller drive circuit 110 a drive stop command signal for stopping drive of the heat roller 30. At the same time, the microcomputer 100 outputs to the DC power source 90 an application stop command signal for stopping the DC power source 90 from applying the second DC voltage. This causes the heat roller 30 to stop rotating and the DC power source 90 to stop application of the second DC voltage. In step 240, the microcomputer 100 terminates processes.

In the present embodiment, because the common electrode layer 36 and the anti-melt layer 37 are formed from extremely thin layers, the thermal resistance of the common electrode layer 36 and the anti-melt layer 37 is extremely small. Therefore, the thermal energy generated at the resistor layer 35 is transmitted to the outer surface of the heat roller 30 with extremely high efficiency. Because temperature sufficient for thermal fixing can therefore be quickly attained, waiting time required until start of thermal fixing is greatly reduced. Because heat is generated to be transmitted only at the nip portion A, the generation and transmission of heat can be accomplished with very little adverse thermal effect to the other components of the thermal fixing device. Also, the amount of power consumed is greatly reduced and the thermal fixing device can be made with a compact structure.

Thus, detection of transportation of the sheet 50 for thermally fixing toner 51 and of completion of transportation as described above is not dependent on any independent sensor, but is accomplished by effective use of the heat roller 30 itself. Changes in pressure at the nip portion A accompanying the thickness of sheets 50 are detected as increases in the first DC current or as decreases in the second DC current. These current changes make the microcomputer 100 aware of the presence or absence of a sheet 50. Therefore the number of sensors required for this type of thermal fixing device can be decreased, which translates into a reduction in cost and an increase in space.

Figure 9:
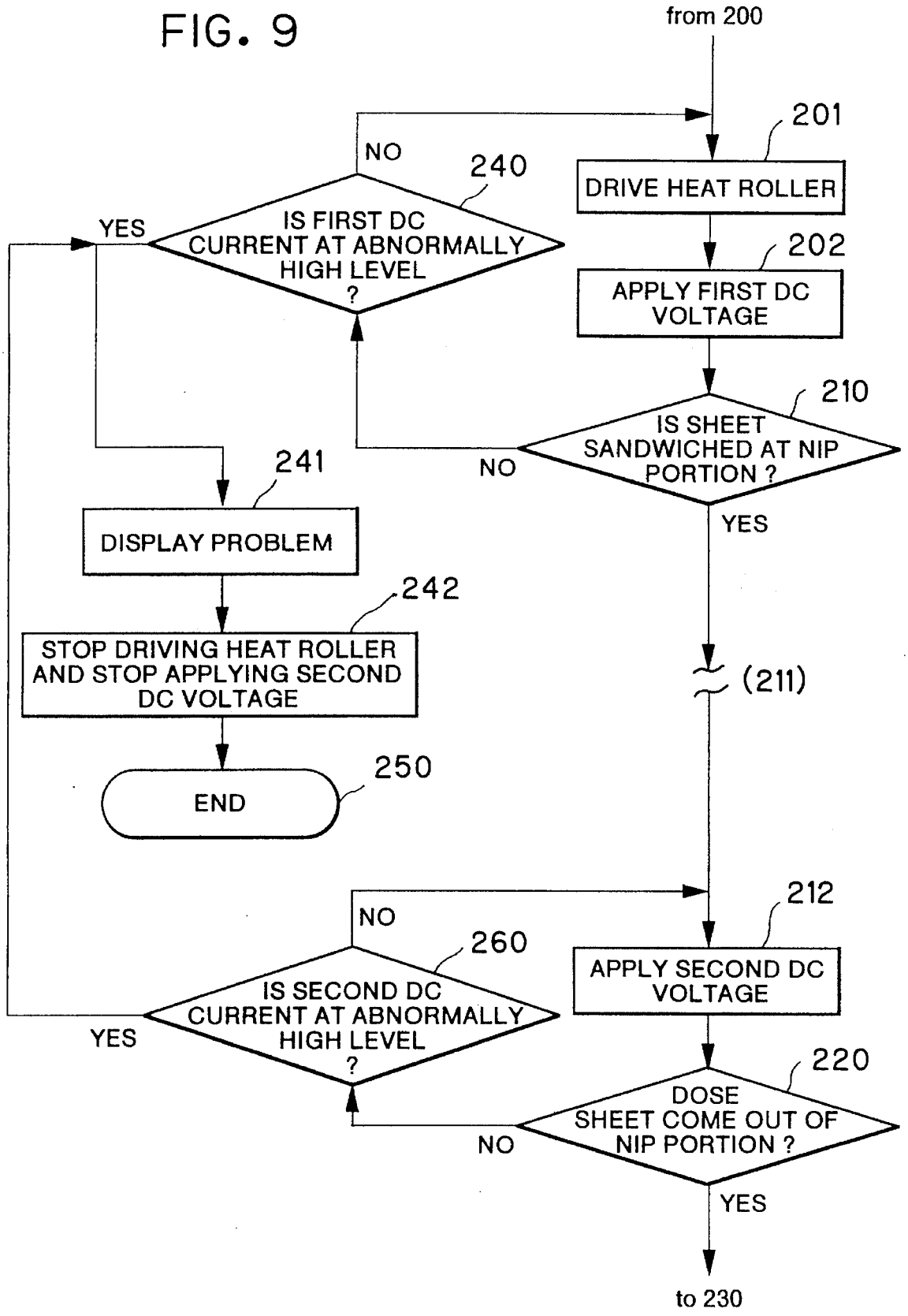
FIG. 9 is a modified flowchart representing a possible modification to the computer program represented in FIG. 8.

Next, an explanation of a modification of the first preferred embodiment will be provided while referring to the two-dot chain line in FIG. 7 and referring to FIG. 9. The thermal fixing device in this modification includes a display circuit 120 in addition to electrical circuitry described in first preferred embodiment. The input of the display circuit 120 is connected with an output of the microcomputer 100. Also, the flowchart in FIG. 8 used to describe the first preferred embodiment is modified as shown in FIG. 9. However, a computer program represented by this modified flowchart is prestored in the ROM of the microcomputer 100 as a second computer program. Other structures are the same as described in the first preferred embodiment.

In this modification, when absence of a sheet is determined in step 210, the program proceeds to step 240, to judge whether the first DC current is at an abnormally high level. More specifically, the step 240 judges whether the first DC current extremely increases from the initial value to exceed the predetermined first range. If not (i.e., step 240 is "NO"), the program returns to step 201. If because of a sheet jam or some other problem the first DC current extremely increases from the initial value to exceed the first predetermined range, the program proceeds to step 241. In step 241, the microcomputer 100 generates a command signal for causing the display circuit 120 to display that a problem has occurred in the thermal fixing device.

In step 242, the microcomputer 100 outputs a drive stop command signal for stopping drive of the heat roller 30 and also outputs to the DC power source 90 an application stop command signal for stopping the DC power source 90 from applying the DC voltage. As a result, the heat roller 30 stops rotating and the DC power source 90 stops applying the DC voltage.

Similarly, when the step 220 judges that a sheet has not yet been discharged out of the nip portion A, the program proceeds to step 260. Whether the second DC current is at an abnormally high level is judged in step 260. More specifically, the step 260 judges whether the second DC current extremely increases to exceed the predetermined second range. If not (i.e., step 260 is "NO"), the program returns to step 212. If because of a sheet jam or some other problem the second DC current extremely increases to exceed the second predetermined range, (i.e., step 260 is "YES"), the program proceeds to step 241, where the processes of step 241–242 are conducted as described above.

This modification prevents damage to the thermal fixing device from problem situations. Other effects of the modification are the same as in the first preferred embodiment.

Figure 10:
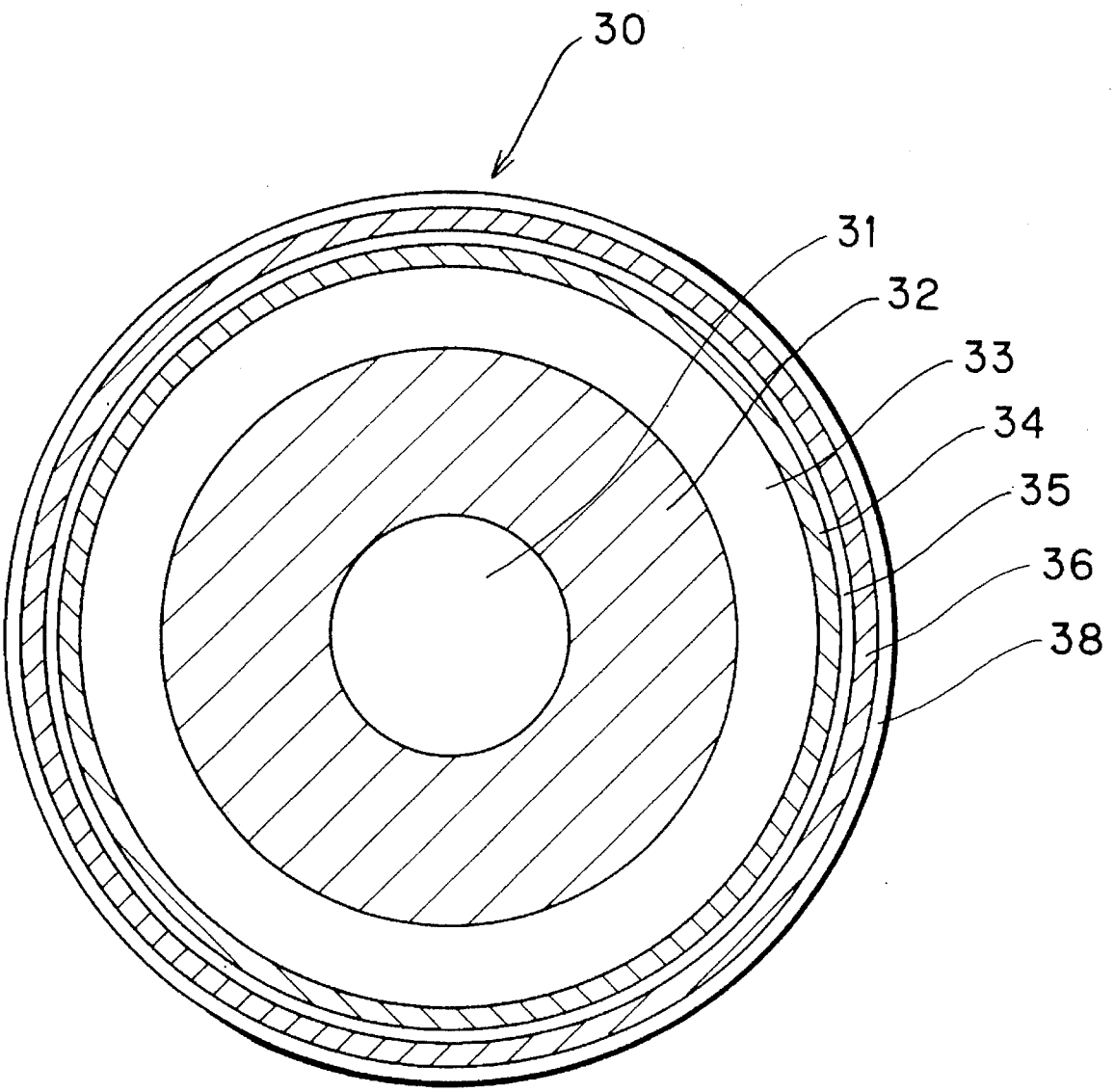
FIG. 10 is a cross-sectional view of a heat roller used in a sheet discharge device according to the a second embodiment of the present invention.

Next, an explanation of a second preferred embodiment will be described while referring to FIGS. 10 and 11. The second preferred embodiment describes the present invention applied to a sheet discharge portion of a laser printer. According to the present embodiment, the laser printer is constructed to include a sheet discharge roller 30A. The sheet discharge roller 30A is supported so as to be rotatable about its axis adjacent to a slot (not shown) provided in the laser printer for discharging a printed sheet therethrough.

The sheet discharge roller 30A is constructed similar to the heat roller 30 described in the first preferred embodiment. However, instead of the anti-melt layer 37 of the heat roller 30, a cylindrical friction layer 38 is formed concentrically to the outer perimeter of the common electrode layer 36 in the sheet discharge roller 30A as shown in FIG. 10. The friction layer 38 is provided to improve friction between the sheet discharge roller 30A and the sheet 50 to be discharged and is therefore made from a thin layer of material that increases friction such as rubber. However, the friction layer 38 need not be made from rubber, but can be made of a thin cylindrical layer of metal provided covered with fine protrusions for increasing the amount of friction between the paper and the friction layer 38.

The pressure roller 40 described in the first preferred embodiment is used in association with the sheet discharge roller 30A to form a nip portion in the sheet discharge roller 30A where the sheet discharge roller 30A and the pressure roller 40 abut. (This nip portion will also be referred to as the nip portion A hereinafter.) As shown in FIG. 12, an electronic circuitry of a drive circuit for driving the discharge roller 30A of the second embodiment is the same as the electronic circuitry of the device of the first embodiment, except that the heat roller drive circuit 110 of the first embodiment is replaced with a discharge roller drive circuit 110A. In the second preferred embodiment, a computer program represented by the flowchart shown in FIG. 11 (instead of the flowchart shown in FIG. 8) is prestored in the memory of the microcomputer 100 as a computer program.

Next, an explanation of discharge operations of a sheet printed on by a laser printer will be provided according to the second preferred embodiment. When the laser printer is turned on, the microcomputer 100 initializes the third computer program in step 300. At this point, no sheet is sandwiched between the sheet discharge roller 30A and the pressure roller 40 and also that no DC voltage is applied to the sheet discharge roller 30A. In the same manner as described in the first preferred embodiment, the electrode portions 33*a* at the nip portion A are in contact with the resistor layer 35 via compression of the resilient layer 34.

Next in step 301A, the microcomputer 100 outputs to the sheet discharge roller drive circuit 110A a drive command signal. This command causes the sheet discharge roller drive circuit 110A to drive the sheet discharge roller 30A to rotate with the pressure roller 40. At the same time, in step 302, the microcomputer 100 outputs to the DC power source 90 a first energization command signal for causing the DC power source 90 to apply the first DC voltage. In the same manner as described in the first preferred embodiment, the DC power source 90 applies the first DC voltage to regions of the sheet discharge roller 30A and the common electrode layer 36 that correspond to the nip portion A. By application of the first DC voltage, the first DC current of the initial value (of the small amount) flows through the electrode layer 33, the electrode portions 33*a*, the resistor layer 35, the common electrode layer 36, the current detection circuit 80, and the DC power source 90 as described in the first preferred embodiment.

In this condition, when the tip end (leading edge) of a printed sheet becomes sandwiched in the nip portion A, the resiliency of the spring members 23*a* and 23*b* increases its biasing force for urging the pressure roller 40 to the sheet discharge roller 30A, by an amount proportional to the thickness of the sheet. This increase in the biasing force is added to the pressure applied to the nip portion A. For this reason, the resilient layer 34 that is already resiliently deformed at the nip portion A is further resiliently compressed. The number of electrode portions 33*a* that contact the resistor layer 35 increases to greater than when no sheet 50 is sandwiched in the nip portion A. Thus, the first DC current detected for the first DC voltage when a sheet 50 is sandwiched in the nip portion A has a value greater than the initial value obtained when no sheet is sandwiched in the nip portion A. This value falls in the predetermined first range, which is determined dependently on the characteristics of the sheet 50 sandwiched in the nip portion A, the first DC voltage, and the resilient characteristics of the coil spring members 23*a* and 23*b* and the resilient layer 34.

Accordingly, when a leading edge of the sheet begins sandwiched at the nip portion A, the first DC current detected for the first DC voltage increases from the initial value to fall in the first predetermined range.

In step 310, the microcomputer 100 determines whether a sheet begins sandwiched in the nip portion A based on the increase in the first DC current. This determination is not dependent of any independent sensor, but instead effectively uses the structure of the sheet discharge roller 30A itself. When the microcomputer 100 detects the increase in the first DC current (i.e., step 310 is "YES"), the program proceeds to step 320. The sheet is transported by rotation of the sheet discharge roller 30A and the pressure roller 40 while sandwiched in the nip portion A. The friction layer 38 improves transport of the sheet so that sheet discharge is smoothly accomplished by the sheet discharge roller 30A.

After the sheet is transported through the nip portion A so that the trailing edge of the sheet is discharged from the nip portion A, the resiliency of the spring members 23*a* and 23*b* decreases their biasing force for urging the pressure roller 40 to the discharge roller 30, by an amount proportional to the thickness of the sheet 50. This drop in the biasing force translates into a decrease in the amount of pressure applied by the pressure roller 40 to the nip portion A of the sheet discharge roller 30A. For this reason, the amount of compression decreases at the resiliently-deformed portion of the resilient layer 34 at the region of the sheet discharge roller 30A corresponding to the nip portion A. The number of electrodes 33*a* of the electrode layer 33 contacting the resistor layer 35 decreases compared to when a sheet 50 is sandwiched in the nip portion A. This translates into a decrease in the area of contact between the electrode layer 33 and resistor layer 35 compared to when a sheet 50 is sandwiched in the nip portion A. Accordingly, when the sheet 50 is discharged from the nip portion A, the value of the first DC current decreases back to the initial value, which is smaller than the value when a sheet 50 is sandwiched in the nip portion A.

In step 320, the microcomputer 100 determines, based on the reduction of the first DC current, that no sheet 50 is sandwiched in the nip portion A. This determination is not dependent on any independent sensor, but is based on effective use of the discharge roller 30 itself. The reduction in pressure at the nip portion A that accompanies discharge of the sheet 50 results in a reduction in the first DC current. If a reduction in the first DC current is detected, the computer program proceeds to step 330.

The step 330 judges whether a next sheet 50 is present to be discharged out of the laser printer. The microcomputer 100 is supplied with information whether the next sheet is present, through a program other than the program of FIG. 11 of discharging operation. For example, when the laser printer is instructed to print a plurality of pages of sheet, the microcomputer is supplied with information whether any page of sheet has not yet been discharged out of the laser printer. The microcomputer 100 achieves the judgment based on the thus supplied information. When a next sheet is judged as present in step 330, the process returns to step 301A, so that the step 301A and on are repeated. On the other hand, when the judgement in step 330 is "NO", in step 331A the microcomputer 100 outputs to the discharge roller drive circuit 110A a drive stop command signal for stopping drive of the discharge roller 30A. At the same time, the microcomputer 100 outputs to the DC power source 90 an application stop command signal for stopping the DC power source 90 from applying the first DC voltage. This causes the sheet discharge roller 30A to stop rotating and the DC power source 90 to stop application of the first DC voltage. In step 340, the microcomputer 100 terminates processes.

Because the first DC current is only a small amount of current and because the heat from the sheet discharge roller 30A by the first DC current and transmission of the heat is limited to the nip portion A, the heat has with very little adverse thermal effect to the other components of the laser printer. This allows making the laser printer with a compact structure. The amount of power consumed is also greatly reduced. Also, as described above, the start and completion of paper discharge is not dependent on any independent sensor, but is based on effective use of the sheet discharge roller 30A itself. That is, changes in pressure at the nip portion A accompanying the thickness of sheets 50 are detected as increases or decreases in the first DC current. These current changes make the microcomputer 100 aware of the presence or absence of a sheet. Therefore the number of sensors required for this type of laser printer can be decreased, which translates to a reduction in costs and an increase in space.

While the invention has been described in detail with reference to specific embodiments thereof, it would be apparent to those skilled in the art that various changes and modifications may be made therein without departing from the spirit of the invention, the Scope of which is defined by the attached claims.

For example, in the thermal fixing device described in the first preferred embodiment, the central axis 31 of the heat roller 30 can be integrally formed with the base portion 32. Also, the base portion 32 can be a hollow space, in which the central axis 31 is concentrically provided. Further, the concentric positions of the electrode layer 33 and the resistor layer 35 can be reversed. Also, the electrode portions 33*a* can be provided to the resistor layer 35 instead of the electrode layer 33.

In the sheet discharging device described in the second preferred embodiment, the resistor layer 35 can be replaced with a cylindrical electrode layer. Alternatively, the resistor layer 35 can be omitted completely and the common electrode layer 36 used in its place. If the pressure roller 40 is provided with a sufficiently resilient surface, the friction layer 38 can be omitted and the common electrode layer 36 be used as the outermost layer of the discharge roller 30A.

In order to detect feed condition of the rollers 30 (30A) and 40, the present invention detects electrical amount obtained for the electrode layers 33 and 36, between which the resilient layer 34 is provided. In the above-described embodiments, the constant-voltage DC power supply 90 is provided to apply a constant voltage between the electrode layers 33 and 36. Detecting the electric current flowing through the electrode layers 33 and 36, as the electrical amount, measures the electrical resistance between the electrode layers 33 and 36, which corresponds to the number of electrode portions 33*a* contacted with the electrode layer 34 and therefore which indicates the feed condition.

In order to measure the electrical resistance between the electrode layers 33 and 36 and detect the feed condition, a constant-current DC power supply may be provided to supply the electrode layers 33 and 36 with a constant electric current. In this case, detecting an electric voltage between the electrode layers 33 and 36 can measure the electrical resistance therebetween. Furthermore, an AC power supply may be provided to apply an alternating voltage or current between the electrode layers 33 and 36, with a capacitor being provided in parallel connection with the electrode layers 33 and 36. In this case, detecting change in phase in alternating voltage or current obtained at the electrode layers 33 and 36 can measure change in the electrical resistance therebetween.

Each of the rollers 30 and 30A of the first and second embodiment serves as a capacitor constituted from the opposing electrode layers 33 and 36. Accordingly, an AC power supply may be provided to apply an alternating voltage or current between the electrode layers 33 and 36. In this case, detecting change in phase in alternating voltage or current obtained at the electrode layers 33 and 36 can measure the change in the capacitance therebetween which also indicates the feed condition.

In the modification of the first embodiment, the steps 240 and 260 in FIG. 9 detect whether or not the first and second DC currents increase to exceed the first and second predetermined ranges, to thereby whether or not the first and second DC currents abnormally increase. The first and second ranges, which are dependent on the characteristics of the sheet to be inserted between the rollers, etc. are previously known. However, other various methods may be applied to detect the abnormal increase.

For example, increase in the first DC current from the initial value occurred for the first time after when the thermal fixing operation of FIG. 8 starts is judged to indicate that the leading edge of the sheet reaches the nip portion A. Then, the second DC voltage is applied between the electrode layers 33 and 36, and the second DC current is detected. The detected value of the second DC current is referred to as a value C. A tolerance range is then calculated based on this value C as a range between C and C+ΔC, where ΔC being previously determined. When the second DC current is detected to exceed this tolerance range, the current is judged to abnormally increase.

In order to determine the timing at which the leading edge of the sheet reaches the nip portion, instead of detecting the first increase in the first DC current, a sensor may be additionally provided on the path of the sheet 50 in front of the thermal fixing device. The sheet 50 is transported at a constant speed to the device. The timing is therefore calculated, based on the timing at which the leading edge of the sheet is detected by the sensor and the transporting speed of the sheet.

The amounts ΔC for determining the tolerance range may be previously determined as various values, dependently on various types or kinds of sheets to be inserted between the rollers. The various values of the amount ΔC may be previously stored in a table, such as ROM, and one of the various values of the tolerance amount ΔC is manually or automatically selected dependently on the kind of a sheet desired to be printed.

Figure 11:
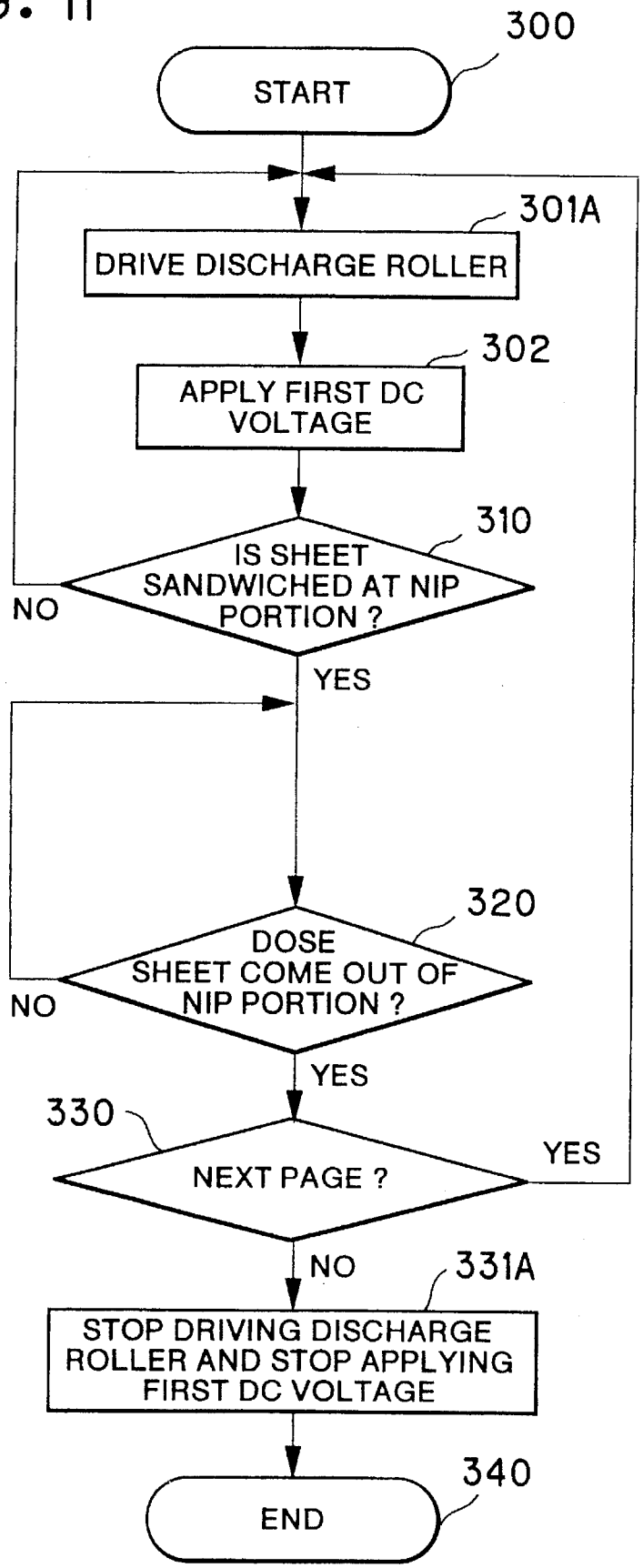
FIG. 11 is a flowchart representing a computer program for stored in a microcomputer of the second preferred embodiment.
Figure 12:
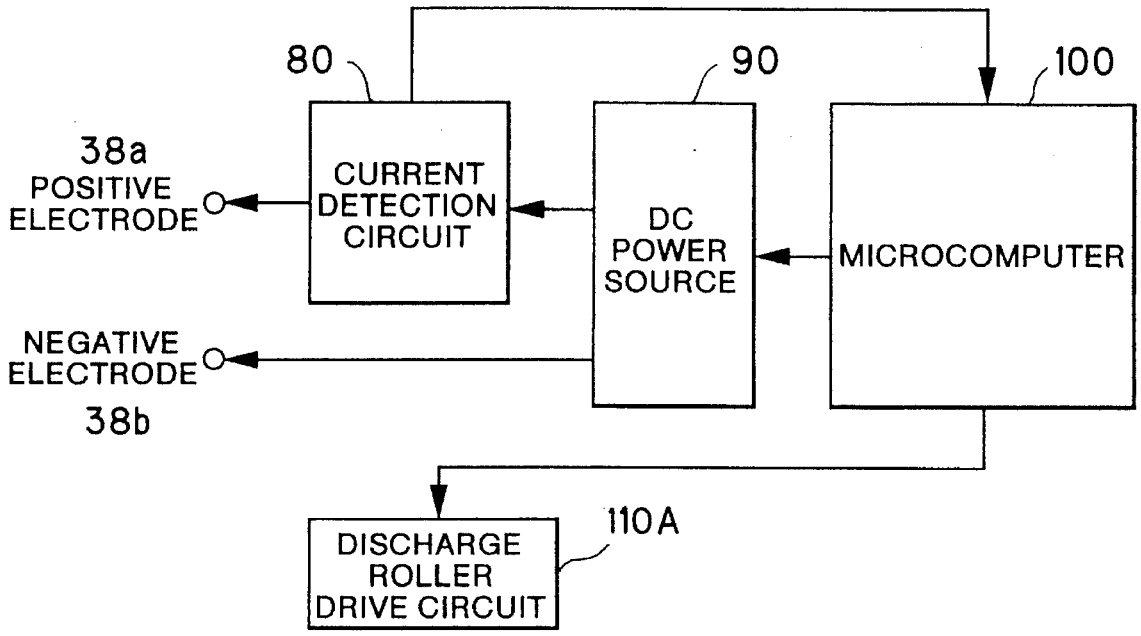
FIG. 12 is a circuit diagram showing circuitry for driving the discharge roller and applying a direct voltage to the discharge roller in the second embodiment.

In the above-described embodiments, in the steps 230 and 330, the microcomputer 100 is supplied with the information whether the next sheet is present, through the program other than the programs of FIGS. 8 and 11 for the thermal fixing operation and the discharging operation. However, a sensor may be additionally provided on the path of the sheet for detecting the presence of the next sheet.

The above-described embodiments are provided with the coil spring members 23*a* and 23*b* which are resiliently deformed by an amount corresponding to the presence and absence of the sheet at the nip portion. The coil spring members therefore apply a biasing force, of an amount corresponding to the presence and absence of the sheet, for urging or pressing the pressure roller against the heat roller or the discharge roller. Accordingly, the resilient layer 34 is resiliently deformed at the nip portion in correspondence with the presence and absence of the sheet. The coil spring members may be replaced with various types of resilient members which can be resiliently deformed to press the pressure roller against the heat roller or the discharge roller with a biasing force of an amount corresponding to the absence and presence of the sheet at the nip portion.

Devices according to the present invention are not limited to thermal fixing devices or laser printers, but can be applied to any device that handles or transports a plane-shaped object.

Start and completion of feeding a medium to be transported is accomplished independent of any independent sensor, and is based on effective use of the roller itself. The change in pressure at the nip portion accompanying the thickness of the object to be fed transported registers as an increase or a decrease in an electrical quantity. Therefore, the number of sensors required for this type of feed roller controller can be decreased, which translates to a reduction in costs and an increase in space. Because electric energy is supplied only to the nip portion, the heat generated in the heat roller 30 gives very little adverse thermal effect to the other components of the feed roller controller. The amount of power consumed is also greatly reduced. Also, the feed roller controller can be made with a compact structure.

What is claimed is:

1. A plate-shaped medium transporting device for transporting a plate-shaped medium, the device comprising:

a feed roller rotatable about a feed roller axis, the feed roller including:

a cylindrical first electrode layer provided substantially concentric with the feed roller axis, the first electrode layer having a plurality of electrode connecting portions formed to an electrode surface thereof at predetermined positions on the electrode surface;

a cylindrical second electrode layer provided substantially concentric with the feed roller axis in confrontation with the electrode surface of the first electrode layer; and a cylindrical and resilient insulation layer provided interposed between the first electrode layer and the second electrode layer, the insulation layer having a plurality of through holes formed therethrough, each through hole being formed at a position in the insulation layer that corresponds to one of the predetermined positions of the electrode surface so that an electrode connecting portion is inserted in each through hole;

a power source for supplying an electric power between the first and second electrode layers of the feed roller;

drive means for driving the feed roller to rotate about the feed roller axis;

a pressure roller rotatable about a pressure roller axis;

a pressing member for resiliently pressing the pressure roller axis toward the feed roller axis so as to form a nip portion between the pressure roller and the feed roller where the pressure roller abuts the feed roller, the insulation layer of the feed roller becoming resiliently compressed at the nip portion so that several ones of the plurality of electrode connecting portions of the first electrode layer are brought into electrical connection with the second electrode layer at the nip portion, the number of the electrode connecting portions thus brought into electric connection increasing when a plate-shaped medium is sandwiched at the nip portion between the feed roller and the pressure roller; and detecting means for detecting change in an electrical amount obtained for the first and second electrode layers of the feed roller, to thereby determine feed condition of the plate-shaped medium.

2. A plate-shaped medium transporting device of claim 1, further comprising:

control means for controlling operation of the drive means, based on the results detected by the detection means.

3. A plate-shaped medium transporting device of claim 2, wherein the power source supplies a direct current electric voltage between the first and second electrode layers of the feed roller, the number of electrode connecting portions brought into electric connection with the second electrode layer increasing when the plate-shaped medium is sandwiched at the nip portion between the feed roller and the pressure roller so as to increase electric current flowing between the first and second electrode layers, and wherein the detection means includes electric current detection means for detecting an electric current flowing between the first and second electrode layers to thereby detect change in the electric current flowing between the first and second electrode layers.

4. A plate-shaped medium transporting device of claim 3, wherein the electric current detection means detects a predetermined original value of electric current when no medium is sandwiched between the feed roller and the pressure roller, and wherein the detection means further includes judging means to judge whether the electric current detected by the electric current detection means increases from the predetermined original value to a value higher than the predetermined original value, to thereby determine whether the plate-shaped medium is sandwiched between the feed roller and the pressure roller at the nip portion.

5. A plate-shaped medium transporting device of claim 4, wherein the judging means further judges whether the electric current detected by the electric current detection means decreases from the value, which is higher than the predetermined original value, back to the predetermined original value, to thereby determine whether the plate-shaped medium is discharged out from between the feed roller and the pressure roller.

6. A plate-shaped medium transporting device of claim 5, wherein the judging means further judges whether the electric current detected by the electric current detection means increases to another value which is extremely higher than the original value, the judging means causing the control means to control the drive means to stop driving the feed roller to rotate upon detecting the increase of the electric current to the other value.

7. A plate-shaped medium transporting device of claim 3, wherein the cylindrical second electrode layer of the feed roller is formed with a resistor layer at one surface in confrontation with the electrode surface of the first electrode layer, the electric current flowing between the first electrode layer and the second electrode layer flowing through the resistor layer at the nip portion.

8. A plate-shaped medium transporting device of claim 7, wherein the power source selectively supplies first and second direct current electric voltages between the first and second electrode layers of the feed roller, the second direct current electric voltage being higher than the first direct current electric voltage and having a value causing an electric current of a value large enough to generate heat in the resistor layer at the nip portion to flow between the first and second electrode layers when the plate-shaped medium is sandwiched between the feed roller and the pressure roller, to thereby thermally fix toners provided on the plate-shaped medium, the control means controlling the power source to selectively supply the first and second direct current electric voltages between the first and second electrode layers, based on the determination by the determination means.

9. A plate-shaped medium transporting device of claim 8, wherein the electric current detection means detects a predetermined original value of electric current when no medium is sandwiched between the feed roller and the pressure roller and when the power source supplies the first direct current electric voltage between the first and second electrode layers, and wherein the control means controls the power source to supply the first direct current electric voltage between the first and second electrode layers so as to cause the judging means to judge whether the electric current detected by the electric current detection means increases from the predetermined original value to a value higher than the predetermined original value, to thereby determine whether the plate-shaped medium is sandwiched between the feed roller and the pressure roller at the nip portion, the control means controlling the power source to start supplying the second direct current electric voltage between the first and second electrode layers at least after when the judging means determines that the plate-shaped medium is sandwiched between the feed roller and the pressure roller at the nip portion.

10. A plate-shaped medium transporting device of claim 1, wherein each of the plurality of electrode connecting portions formed to the electrode surface of the first electrode layer includes a cylindrically-shaped electrode portion protruding from the electrode surface, the cylindrically-shaped electrode portion being inserted into a corresponding through hole formed in the insulation layer.

11. A plate-shaped medium transporting device of claim 10, wherein a height of each of the plurality of electrode connecting portions protruded from the electrode surface of the first electrode layer is lower than a thickness of the resilient insulation layer so as to form a gap between a tip end of each of the plurality of electrode connecting portions and the second electrode layer, the tip ends of the several ones of the plurality of electrode connecting portions being brought into electrical connection with the second electrode layer at the nip portion when the resilient insulation layer is resiliently compressed at the nip portion.

12. A plate-shaped medium transporting device of claim 1, wherein the feed roller further includes a cylindrical outermost layer provided substantially concentric with the feed roller axis for contacting the plate-shaped medium when the plate-shaped medium is sandwiched at the nip portion, the cylindrical outermost layer being made of anti-melt material to prevent toner on the plate-shaped medium from sticking to the feed roller.

13. A plate-shaped medium transporting device of claim 1, wherein the feed roller further includes a cylindrical outermost layer provided substantially concentric with the feed roller axis for contacting the plate-shaped medium when the plate-shaped medium is sandwiched at the nip portion, the cylindrical outermost layer providing high amount of friction with respect to the plate-shaped medium.

14. A plate-shaped medium transporting device of claim 1, wherein the pressure roller includes a cylindrical resilient layer provided substantially concentric with the pressure roller axis, the resilient layer being made of resilient material.

15. A plate-shaped medium transporting device of claim 1, wherein the pressing member includes a resilient member for being resiliently deformed to urge the pressure roller against the heat roller to form the nip portion, with a biasing force of an amount corresponding to the feed condition of the plate-shaped medium at the nip portion.

16. A feed roller control device for controlling a feed roller to transport a plate-shaped medium, the device comprising:

a feed roller rotatable about a feed roller axis, the feed roller including:

a cylindrical first electrode layer provided substantially concentric with the feed roller axis, the first electrode layer having a plurality of electrode connecting portions formed to an electrode surface thereof at predetermined positions on the electrode surface;

a cylindrical second electrode layer provided substantially concentric with the feed roller axis in confrontation with the electrode surface of the first electrode layer; and a cylindrical and resilient insulation layer provided interposed between the first electrode layer and the second electrode layer, the insulation layer having a plurality of through holes formed therethrough, each through hole being formed at a position in the insulation layer that corresponds to one of the predetermined positions of the electrode surface so that an electrode connecting portion is inserted in each through hole;

a power source for supplying an electric voltage between the first and second electrode layers of the feed roller;

a pressure roller rotatable about a pressure roller axis;

a drive source for driving the feed roller and the pressure roller to rotate about their roller axes;

a pressing member for being resiliently deformed to urge the pressure roller axis toward the feed roller axis with a biasing force to form a nip portion between the pressure roller and the feed roller where the pressure roller abuts the feed roller, the biasing force having an amount corresponding to feed condition of the plate-shaped medium at the nip portion, the insulation layer of the feed roller being resiliently compressed at the nip portion in correspondence with the amount of the biasing force so that several ones of the plurality of electrode connecting portions of the first electrode layer are brought into electrical connection with the second electrode layer at the nip portion, the number of the electrode connecting portions thus brought into electric connection corresponding to the amount of the biasing force so as to increase when a plate-shaped medium is sandwiched at the nip portion between the feed roller and the pressure roller;

a detecting unit for detecting change in an amount of electrical current flowing between the first and second electrode layers of the feed roller, to thereby determine the feed condition of the plate-shaped medium; and a controller for controlling operation of at least one of the drive source and the power source, based on the results detected by the detecting unit.

* * * * *